United States Patent [19]

Mendelsohn

[11] 4,448,297

[45] May 15, 1984

[54] FERROMAGNETIC COIN VALIDATOR AND METHOD

[76] Inventor: Lewis I. Mendelsohn, King's Point, Valencia, 34B, c/o Toscher, Del Ray Beach, Fla. 33446

[21] Appl. No.: 275,115

[22] Filed: Jun. 18, 1981

[51] Int. Cl.[3] ..... G07F 3/02

[52] U.S. Cl. ..... 194/100 A

[58] Field of Search ..... 194/100 A, 100 R, 99, 194/97 R; 73/163

[56] References Cited

U.S. PATENT DOCUMENTS

| | | | |
|---|---|---|---|
| 2,817,060 | 12/1956 | Stateman et al. . | |
| 3,059,749 | 10/1962 | Zinke . | |
| 3,596,744 | 8/1971 | Chesnokov . | |
| 3,599,771 | 8/1971 | Hinterstocker . | |
| 3,741,363 | 6/1973 | Hinterstocker . | |
| 4,124,111 | 11/1978 | Hayashi | 194/100 A |
| 4,151,904 | 5/1979 | Levasseu et al. . | |

FOREIGN PATENT DOCUMENTS

| | | | |
|---|---|---|---|
| 2425803 | 12/1975 | Fed. Rep. of Germany | 194/100 A |

*Primary Examiner*—Stanley H. Tollberg
*Attorney, Agent, or Firm*—Heslin & Watts

[57] ABSTRACT

A sensing device determines whether the ferromagnetic properties of a standard acceptable coin are matched by a coin under test. The two are compared in a sensing device which consists of a pair of substantially identical sensing coils wound around tube chutes so that each coin becomes the core of its associated coil. The sensing coils are, in turn, placed within the windings of a larger exciting coil used to induce voltages in the sensing coils. All the coils are rectangular in shape and the coins are forced to remain in an endwise relationship within the sensing coils so that their planes are parallel to the axes of their associated coils. The sensing coils are connected in a series opposed relationship so as to be "bucking" one another. Their combined output is fed into suitable circuitry for determining whether this output goes to zero or a voltage near zero within acceptable limits. If it does, then the coin is accepted as valid. If not, the coin is rejected as invalid. Suitable coin handling devices may be included for segregating valid coins from invalid ones or for causing other things to occur. The exciting coil is driven by a suitable ocsillator. The entire system can be turned on by a suitable switching device as a coin approaches the test system.

11 Claims, 3 Drawing Figures

FIG. 1
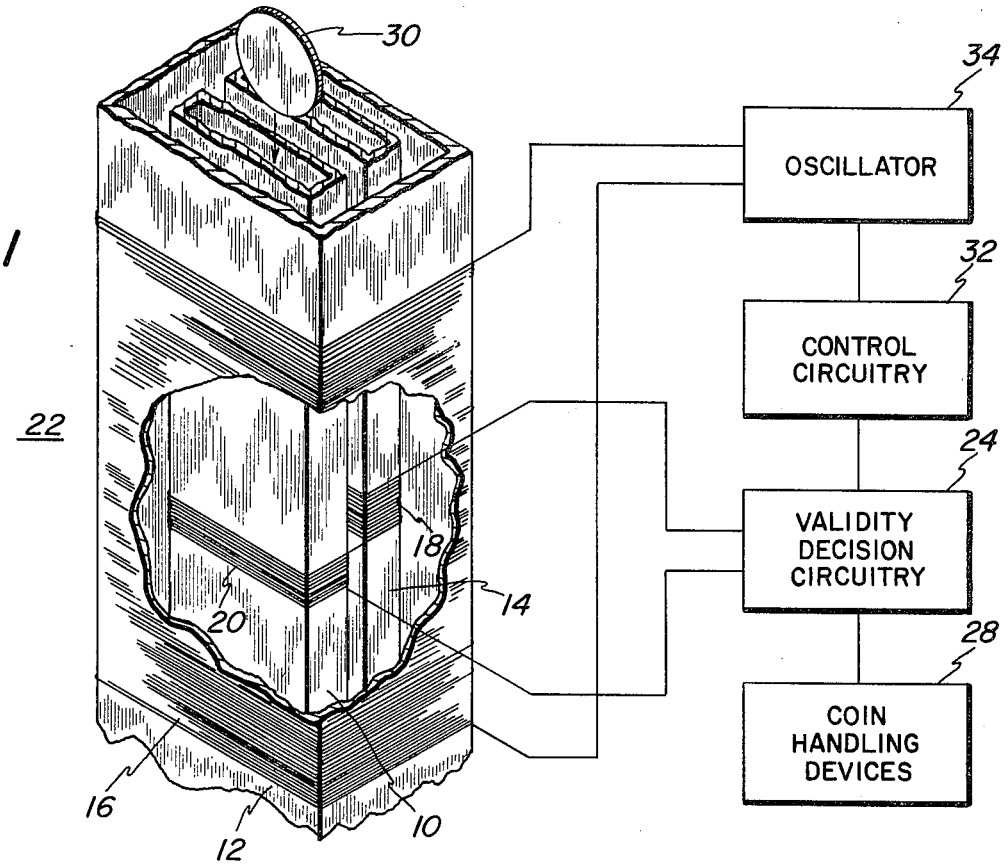
FIG. 2
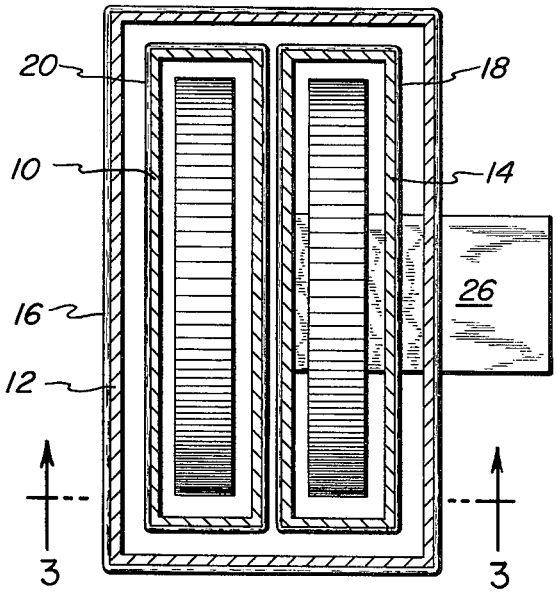
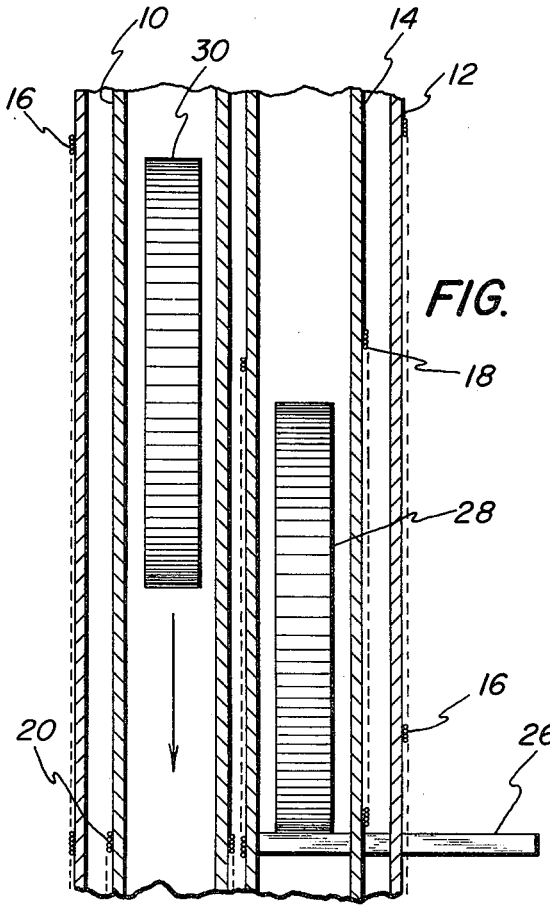
FIG. 3

FERROMAGNETIC COIN VALIDATOR AND METHOD

BACKGROUND AND SUMMARY OF THE INVENTION

This invention relates to systems for checking the validity of coins used to operate vending machines and other apparatus in order to detect and reject counterfeits.

It is a common experience for the proprietors of vending machines and coin operated systems of various types, such as amusement games, washing machines and dryers, to suffer the loss of revenue because certain patrons use slugs or other invalid coinage. In order to deal with this problem, a great number of systems have been designed to detect and reject spurious coinage. These systems generally are based on one or more electrical characteristics of a valid coin. U.S. Pat. No. 3,599,711 to Hinterstocker, for example, appears to rely upon the known conductivity of valid coins. In that system, a standard coin and a test coin are used to affect the coupling between a primary coil and two pickup coils and the results compared. If the conductivity of the test coin matches that of the standard coin, then a null reading should be obtained when the pickup coils are connected in series opposition so that they are "bucking" one another. The system described in U.S. Pat. No. 3,596,744 to Chesnokov uses two coils wound around a coin chute, one coil being a primary and the other a secondary. The coils are spaced sufficiently far apart so that they are not inductively coupled; yet, they are sufficiently close so that they may be inductively coupled when a coin, having a ferromagnetic phase, is passing. When that happens, an EMF is induced in the secondary coil and its magnitude will be dependent upon the ferromagnetic properties of the coin. U.S. Pat. No. 4,151,904 to Lavasseur, et al., also has a coil wrapped around a chute, which coil is driven by an oscillator at a known frequency. This system operates by detecting the change in frequency which occurs on the passing of a coin. The frequency change is related to the conductive properties of the coin under test and should fall within predetermined limits for known valid coins.

One of the desirable attributes of a coin validation system based upon a determination of its ferromagnetic phase is that it is difficult to fabricate spurious coinage that will be accepted as valid by the system. This is because the ferromagnetic content or phase of a coin can be held within rather close tolerances during its manufacture. Alloys having a ferromagnetic phase have what has been called an "intrinsic induction" which depends only on the temperature and chemical composition of the ferromagnetic phase. This intrinsic induction determines the permeability of the material and hence, the degree to which it can change the inductance of a coil when used as the core thereof. For materials deriving their ferromagnetism from a single element, such as iron, nickel or cobalt, processing such as sintering, casting, rolling, coining, etc., do not affect the intrinsic induction since they do not modify the ferromagnetic atomic structure.

The intrinsic induction in a composite material having iron as its only ferromagnetic phase varies linearly in proportion to the iron concentration. For example, compacts of brass and iron powders can be made with the iron varying from 0% to 60%. Thus, it is possible to "tag" coins by preparing them with a prescribed amount of iron as the single ferromagnetic substance therein. Indeed, one can prepare coins having different percentages of iron therein so that they can be used on some random basis. For example, in an amusement part, the operator might issue coins having a first concentration of iron for a certain time period during which such coins would be acceptable. Later, the concentration could be changed to thwart those who may have been able to successfully duplicate the initial issue of coins.

In order to take advantage of magnetic tagging as a means of coin validation, one must be able to accurately discern differences in the ferromagnetic properties of coins. The degree of accuracy required does not appear to be available in any prior art device of which I am aware. I have discovered, however, a system in which the necessary degree of sensitivity can be achieved. Moreover, the basic sensing unit and associated circuitry is relatively simple and inexpensive to manufacture. Because of its simplicity and its use of well-known materials and components, it is extremely reliable and should provide relatively trouble-free operation.

My invention centers in the provision of an induction coil system wherein a test coin is compared with a standard coin. The key to my invention lies in the configuration and arrangement of secondary or pickup coils within a magnetic field and the provision of structures which will result in having the planes of the coins involved generally parallel to the flux lines of the magnetic field in which the pickup coils are placed. Such an arrangement minimizes the demagnetizing effects normally experienced when permeable materials are placed in a magnetic field and permits maximum magnetization thereof. This is quite important because the resultant changes in the EMF's produced by the pickup coils are relatively small and, therefore, must be maximized.

Briefly stated, the preferred embodiment of this invention involves the winding of a pickup coil around the coin chute of the vending machine or other apparatus which one desires to monitor. A substantially identical pickup coil is wrapped around a similar chute placed alongside of the coin chute. Then both chutes are enveloped by the windings of a primary coil which will serve to induce voltages in the pickup coils. The pickup coils are connected in a series opposed relationship with one another and their combined output fed to appropriate analyzing circuitry. Assuming the coils to be balanced so as to produce a null reading, one determines the validity of coins by using a standard coin as the core for one pickup coil while a coin to be tested is used as the core for the other pickup coil. Assuming the two similarly shaped and sized coins are made of materials having the same ferromagnetic properties, the combined output of the coils should continue to be null.

Otherwise stated, the method of this invention is to place a pair of identical coils in a substantially uniform magnetic field and then to use a standard coin of known ferromagnetic properties and a coin to be tested as core materials for the respective pickup coils. Assuming a match in the ferromagnetic composition of the two coins, as well as a match in shape and size, one should obtain a null reading for coils connected in a "bucking" relationship.

BRIEF DESCRIPTION OF THE DRAWINGS

FIG. 1 is a perspective view of a sensing device employing the invention with its associated circuitry shown in block form.

FIG. 2 is a top plan view of the sensing element.

FIG. 3 is a cross-sectional view on line 3—3 of FIG. 1.

FIG. 1 shows a sensing device 22 in which a section of a test coin chute 10 runs within an outer tube 12. A standard coin chute 14 is located alongside test coin chute 10 within tube 12. Test coin chute 10 would normally be a segment of the coin chute typically found in a vending machine or other machine being monitored. However, this segment as well as chute 14 and tube 12 are preferably made of a non-ferromagnetic substance such as LEXAN or some other suitable material for reasons which will be apparent below. Standard coin chute 14 can be of whatever length may be convenient for the purposes described herein, but it should otherwise be similar to test coin chute 10 in cross-sectional configuration and thickness.

Primary coil 16 is wound on outer tube 12. A first pickup coil 18 is wound on standard coin chute 14 while a second pickup coil 20 is wound on test coin chute 10. Coils 18 and 20 are connected to each other in series opposition so that they are "bucking." The configuration of the pickup coils 18 and 20, as well as their relative positions with respect to each other and with respect to primary coil 16 is such that substantially equal voltages will be induced in them, assuming their cores to be the same. Thus, sensing device 22 is preferably a null instrument and produces no output when the cores of the pickup coils are matched.

A conventional oscillator 34 is connected to primary coil 16. The invention will operate satisfactorily at any frequency within the range of about 20 Hz to about 20K Hz. This wide range of frequencies is available because the invention will be responsive to the ferromagnetic properties of the coins under test throughout that entire range. The output from pickup coils 18 and 20 is fed into circuitry for deciding whether a particular coin 30 under test is valid. Thus, validity decision circuitry 24 might consist of circuitry which would provide an indication in the form of an electrical signal if the combined output voltage of coils 18 and 20 does not go to zero during a test, or at least fall to a positive or negative voltage value around zero and within acceptable limits. This, of course, assumes that the pickup coils 18 and 20 are connected in a "bucking" relationship, as indicated above. Clearly, it would also be possible to operate the invention with the pickup coils in an additive relationship so that a test coin should produce a combined output for the two pickup coils of a certain voltage. Then, the validity decision circuitry 24 would need to be modified accordingly to react to voltages at that level and to provide an indication when a test coin does not produce the predicted voltage or one within reasonable tolerances.

The output of the validity decision circuitry 24 may be used to control a coin handling device 28. Such devices might include, for example, a coin deflector operated by a solenoid for causing invalid coins to be deflected into a separate container so as to segregate them from valid coins.

FIGS. 2 and 3 show the physical relationship between the outer tube 12, test coin chute 10 and standard coin chute 14, as well as the primary coil 16 and the pickup coils 18 and 20. Standard coin chute 14 is provided with a mechanical stop 26 for holding a standard coin 28 in position. It will be noted that the coin stands endwise within pickup coil 18 so that the plane of coin 28 is generally parallel with the axes of coil 18. Coil 18 as well as coils 20 and 16 are actually rectangular in cross-section in the preferred embodiment of this invention and one can think of the coil axis is passing through the geometric center of its respective coil. It should also be mentioned that one or more of the coils used in this invention could have a shape other than rectangular if other shapes are more convenient in particular applications. It is my belief, however, that the rectangular shape is preferred because it results in the maximum concentration of magnetic flux lines in a direction parallel to the axis of the chutes. Since the chutes are chosen to accommodate the physical dimensions of the coins within reasonably close tolerances, the coins are forced to remain in an endwise position within chutes 14 and 10. Thus, the plane of the coins is generally parallel with the flux lines of the magnetic field produced by primary coil 16 and the maximum effects due to the ferromagnetism of the coins will therefore be achieved.

FIG. 3 also shows a test coin passing through coin chute 10. Although a mechanical stop could be provided to momentarily detain test coin 30 at a point where it has achieved positional correspondence with standard coin 28, it may be more convenient to trigger the electronics of the invention as the coin passes a certain point in the test coin chute prior to its reaching the test position within pickup coil 20. An appropriate signal fed into control circuitry 32, for example, could be used to activate oscillator 34 as well as the decision circuitry 24. Such signal could be provided through the operation of a mechanical trip switch (not shown) or any other suitable device.

In operation, the system just described would first be balanced without any coins or other core materials within chutes 10 and 14. Assuming the pickup coils 18 and 20 to be in a bucking relationship, balance would be achieved when their combined output voltage is zero. Presumably, this balancing would take place as part of the manufacturing process for the invention by adjusting the turns in pickup coils 18 and 20 as needed while oscillator 34 is activated. In actual use, a standard coin of known ferromagnetic properties would be placed in standard coin chute 14 against mechanical stop 26. Patrons using the vending machine or other apparatus being monitored would then be issued or expected to have similarly shaped coins having, in addition, the same ferromagnetic properties. When such coins 30 are deposited in test coin chute 10, they will eventually reach positional correspondence in pickup coil 20 with standard coin 28 within pickup coil 18. At that point, the associated circuitry will determine whether the combined output of coils 18 and 20 is zero or satisfactorily close thereto. If so, then the coin would be treated as valid. Otherwise, it would be deflected or otherwise rejected by a coin handling device 28 as an invalid coin. To thwart the efforts of those attempting to use slugs or other forms of invalid coinage, the properietor of the system can periodically change standard coin 28 to another coin having identical shape, but a different quantity of ferromagnetic phase and issue similar coins to his patrons.

What has just been described is the preferred embodiment of this invention. As always, various modifications can be made to it without departing from its essential characteristics. For example, it might be more convenient for some applications to locate primary coil 16 between standard coin chute 14 and test coin chute 10. Clearly, such an arrangement would be satisfactory so long as the axes of primary coil 16 and pickup coils 18 and 20 remained essentially parallel with one another.

Alternatively, an entirely different source for the alternating electromagnetic field could be used. All that is required is that a suitable field having generally parallel flux lines and uniform strength be provided in which the pickup coils can be placed. For other applications where individual testing of coins might be done more slowly, a single coin chute could be used on which the pickup coils would be wound, one above the other. Then mechanical stops could be used to detain a standard coin and a test coin at appropriate positions while the test would be conducted. Obviously, such an arrangement would not provide the quick processing of coins of which the preferred embodiment is capable. In any event, the scope of this invention is intended to be limited only by the claims which follow.

What is claimed:

1. Apparatus for validating a coin or other object comprising:

a primary coil connected to an oscillator;

a first pickup coil within the windings of the primary coil and having the axis of its windings disposed substantially parallel with the axis of the primary coil;

a second pickup coil within the windings of the primary coil and having its windings disposed substantially parallel with the axis of the primary coil;

the configuration and turns of the second pickup coil being substantially the same as the first pickup coil so that the inductive properties of the two pickup coils are substantially the same, means for holding a standard coin of known ferromagnetic properties within the first pickup coil so that the plane of the coin is substantially parallel with the axis of that coil;

means for passing a test coin through the second pickup coil so that the plane of the test coin is substantially parallel with the axis of that coil; and means for sensing the combined output of the pickup coils as the test coin passes through the second pickup coil.

2. The apparatus of claim 1 wherein the two pickup coils are connected in series opposition with one another so that their combined output will be null when they are provided with identical cores.

3. The apparatus of claim 1 or 2 wherein the pickup coils are substantially rectangular in cross-section, their central opening being sufficiently large to permit passage of coins whose validity is to be determined.

4. The apparatus of claim 3 wherein the primary coil is substantially rectangular in cross-section.

5. The apparatus of claim 4 wherein all the coils are wound on tubing made of a non-ferromgnetic material.

6. The apparatus of claim 5 in further combination with:

circuit means connected to the sensing means for providing an indication when the combined output of the pickup coils is not between preselected values; and coin handling devices connected to the circuit means to be responsive to said indication for segregating valid coins from invalid ones.

7. A method for checking the validity of coins comprising the steps of arranging a pair of pickup coils within the windings of a primary coil so that the axes of all coils are parallel and so that voltages induced in the pickup coils by excitation of the primary coils will be substantially the same when the pickup coil cores are substantially the same;

connecting the pickup coils in series opposed relationship to one another;

balancing the outputs of the pickup coils with air cores so that their combined output is null;

placing a standard coin of known ferromagnetic properties within one of the pickup coils so that the plane of the coin is parallel with the axis of the coil;

passing a test coin through the other pickup coil with the plane of the coil parallel to the axis of that coil; and sensing the combined output of the pickup coils when the standard coin and the test coin are in positional correspondence within their associated pickup coils.

8. Apparatus for validating a coin or other object having a ferromagnetic phase comprising:

means for producing an alternating electromagnetic field at least a portion of which is characterized by substantially parallel flux lines and substantial uniformity of strength;

a first pickup coil placed within the said portion of the electromagnetic field and having the axis of its windings disposed substantially parallel with said flux lines;

a second pickup coil disposed within said portion of the electromagnetic field and having the axis of its windings disposed substantially parallel with said flux lines;

the configuration and turns of the second pickup coil being substantially the same as the first pickup coil so that the inductive properties of the two pickup coils are substantially the same;

means for holding a standard coin of known ferromagnetic properties within the first pickup coil so that the plane of the coin is substantially parallel with the axis of that coil;

means for passing a test coin through the second pickup coil so that the plane of the test coin is substantially parallel with the axis of that coil; and means for sensing the combined output of the pickup coils as the test coin passes through the second pickup coil.

9. The apparatus of claim 8 in further combination with at least one set of coins of uniform size and shape bearing a preselected ferromagnetic phase.

10. The apparatus of claim 9 wherein said coins are produced either by alloying or by mixing non-ferromagnetic powders with specified amounts of ferromagnetic powders.

11. The apparatus of claim 9 or 10 wherein the ferromagnetic phase is iron which constitutes a percentage of the coin material ranging from 0% to 60%.

* * * * *